US005723081A

United States Patent [19]

Blankenbeckler et al.

[11] Patent Number: 5,723,081

[45] Date of Patent: Mar. 3, 1998

[54] DISPERSION SPINNING PROCESS FOR POLYTETRAFLUOROETHYLENE AND RELATED POLYMERS

[75] Inventors: Nicole Lee Blankenbeckler, Richmond; Joseph Michael Donckers, II, Midlothian; Warren Francis Knoff, Richmond, all of Va.

[73] Assignee: E. I. du Pont de Nemours and Company, Wilmington, Del.

[21] Appl. No.: 770,531

[22] Filed: Dec. 20, 1996

[51] Int. Cl.[6] ..... D01F 6/12

[52] U.S. Cl. ..... 264/127; 264/178 F; 264/187

[58] Field of Search ..... 264/127, 178 F, 264/187

[56] References Cited

U.S. PATENT DOCUMENTS

| | | | |
|---|---|---|---|
| 2,772,444 | 12/1956 | Burrows et al. | 264/127 |
| 2,951,047 | 8/1960 | Lantos | 264/127 X |
| 3,055,852 | 9/1962 | Youse | 428/336 |
| 3,078,242 | 2/1963 | Morgan | 524/233 |
| 3,114,672 | 12/1963 | Schott | 162/157.3 |
| 3,118,846 | 1/1964 | Boyer | 264/127 |
| 3,147,323 | 9/1964 | Boyer | 264/211 |
| 3,148,234 | 9/1964 | Boyer | 264/211 |
| 3,242,120 | 3/1966 | Steuber | 524/21 |
| 3,655,853 | 4/1972 | Gallup | 264/127 |
| 3,670,069 | 6/1972 | Mitchell et al. | 264/187 |

FOREIGN PATENT DOCUMENTS

| | | | |
|---|---|---|---|
| 63-126911 | 5/1988 | Japan . | |
| 813332 | 5/1959 | United Kingdom . | |
| 1043871 | 9/1966 | United Kingdom | 264/127 |
| 1407132 | 9/1975 | United Kingdom . | |
| 2 220 881 | 1/1990 | United Kingdom . | |
| 2 284 421 | 6/1995 | United Kingdom . | |

OTHER PUBLICATIONS

Cellul. Chem. Technol. 18, No. 6:587–605 (1984), *Spinning and Investigation of Fibers Based on Low–Substituted Hydroxyethylcellulose Ethers I. Preparation and Investigation of the Physicochemical Properties of Low–Substituted Hydroxyethylcellulose and Its Solutions,* Mostovykh, et al.

Cellul. Chem. Technol. 19, No. 1:15–36 (1985), Spinning and Investigation of Fibers Based on Low–Substituted Hydroxyethylcellulose Ethers II. *Preparation and Investigation of the Physicochemical Properties of Low–Substituted Hydroxyethylcellulose,* Mostovykh, et al.

Fibre Chemistry, A translation of Khimicheskie Volokna, vol. 15, No. 5, Sep.–Oct. 1983, pp. 358–361, May, 1984 Issue, *Structure of Fibres Based on Low–Substitution Hydroxyethylcellulose,* Mostovykh, et al.

Fibre Chemistry, A translation of Khimicheskie Volokna, vol. 4, No. 6, Nov.–Dec. 1972, pp. 638–641, *Spinning Fibre From Low–Substituted Ethoxy–Cellulose,* L.P. Perepechkin and E. E. Katalevskii.

*Primary Examiner*—Leo B. Tentoni

[57] ABSTRACT

A process for preparing a dispersion spun fluorinated polymer fiber wherein the intermediate fiber structure, immediately before sintering, contains primarily ions characterized as fugitive ions.

6 Claims, No Drawings

DISPERSION SPINNING PROCESS FOR POLYTETRAFLUOROETHYLENE AND RELATED POLYMERS

This invention relates to a process for spinning a dispersion of poly(tetrafluoroethylene) or related polymers into fibers, or for forming such a dispersion into shaped articles in which the sintered fluorinated polymer structure is substantially free of process salts, acids and other impurities.

BACKGROUND OF THE INVENTION

The outstanding stability of poly(tetrafluoroethylene) and related polymers on exposure to light, heat, solvents, chemical attack and electrical stresses, makes these polymers and articles made from these polymers desirable for a variety of uses. But because of the complexities involved with melt and solution processing of these polymers, it is very difficult to spin or shape them by conventional methods.

One method which is used to shape or spin poly (tetrafluoroethylene) and related polymers is to shape or spin the polymer from a mixture of an aqueous dispersion of the polymer particles and viscose, where cellulose xanthate is the soluble form of the matrix polymer, as was taught in U.S. Pat. Nos. 3,655,853; 3,114,672; and 2,772,444.

Even though viscose is commonly employed in forming fibers from poly(tetrafluoroethylene) and related polymers, the use of viscose suffers from some serious disadvantages.

Alternatives to a viscose forming are known, but the use of other matrix polymers have also generally involved the use of an organic solvent, a surfactant, or both, such as was taught in U.S. Pat. Nos. 3,147,323; 3,118,846 and 2,951,047.

Processes for producing acceptable sintered fluorinated olefinic polymer articles or fibers have generally required that the matrix polymer be carefully selected to assure that the intermediate fiber was free of ions or impurities. The present process allows for the use of a wide range of matrix polymers of various structures and chemical types, while at the same time, it produces strong sintered fibers and articles.

During dispersion spinning or forming, ions from the coagulation bath become incorporated into the intermediate structure. These ions, for example hydrogen, sodium and sulfate ions, may cause serious problems in conversion of the intermediate fiber structure into the finished, sintered (coalesced) fluorinated olefinic polymer fiber.

The typical coagulation bath used in dispersion forming is an acid bath containing sulfuric acid and sodium sulfate. Acid residues from the sulfuric acid cause the intermediate fiber structure to degrade under the temperature conditions necessary to coalesce the fluorinated polymer. The presence of salt, which may sometimes accumulate to levels as high as 25% by weight of the fiber structure, is likely to produce a fiber with unacceptable mechanical strength. In most cases a high concentration of salt in the intermediate fiber structure may even prevent the formation of a sintered fiber since it is very difficult, if not impossible, to sinter the intermediate fiber structure containing residual salt.

The inventors of the present invention have found that strong sintered fluorinated polymer fibers, having high purity, may be made from intermediate structures that carry essentially fugitive ions. Or in the alternative, the present invention provides intermediate structures that are essentially free of nonfugitive ionic residue.

SUMMARY OF THE INVENTION

The present invention provides a process for making a dispersion spun fluorinated olefinic polymer fiber comprising the steps of:

(a) forming a mixture of an aqueous dispersion of particles of the fluorinated olefinic polymer with a aqueous solution of a matrix polymer;

(b) extruding the mixture into a coagulation bath containing a concentration of ions which coagulate the matrix polymer to form an intermediate fiber structure which carries ionic species; and (c) sintering the intermediate fiber structure to decompose the matrix polymer and coalesce the fluorinated olefinic polymer particles wherein immediately before sintering the ionic species are primarily fugitive ions wherein fugitive ions are those ions and partially ionized compounds which on heating to temperatures above 25° C., but below temperatures that cause coalescence of the fluorinated olefinic polymer particles volatilize or decompose to form only volatile substances or carbonaceous residues.

One mode of practicing the present invention is to form the intermediate fiber structure by coagulating the matrix polymer in a solution containing essentially fugitive ions.

In another mode of practicing the present invention the intermediate fiber structure carrying substantially only fugitive ions is formed, when subsequent to coagulating the matrix polymer in a coagulation solution containing ionic species selected from the group consisting of nonfugitive, fugitive or mixtures thereof, but before sintering, the intermediate fiber structure is contacted with an ion replacing solution which contains essentially fugitive ions.

The process of the present invention may be used to form multifilament yarns or monofilament, films, ribbons and other shaped articles.

DETAILED DESCRIPTION

As used herein, the term poly(tetrafluoroethylene) and related polymers means poly(tetrafluoroethylene) and polymers generally known as fluorinated olefinic polymers, for example, co-polymers of tetrafluoroethylene and hexafluoropropene (FEP), co-polymers of tetrafluoroethylene and perfluoroalkyl-vinyl ethers such as perfluoropropyl-vinyl ether (PFA) and perfluoroethyl-vinyl ether, fluorinated olefinic terpolymers including those of the above-listed monomers and other tetrafluoroethylene based co-polymers.

As used herein the term PTFE means poly (tetrafluoroethylene).

As used herein the term aqueous dispersion means a particle dispersion made in water which may contain various surface active additives and additives for adjustment of pH and maintaining the dispersion.

By the term dispersion forming is meant the process by which a dispersion of insoluble polymer particles is mixed with a solution of a soluble matrix polymer, and this mixture is coagulated by contacting the mixture with a coagulation solution in which the matrix polymer becomes insoluble.

Dispersion forming, generally known as dispersion spinning for fiber articles, is useful in producing shaped articles from fluorinated polymers. These polymers, which are difficult to form by melt extrusion or solution spinning, may be successfully spun from a mixture of an aqueous dispersion of fluorinated polymer particles mixed with a solution of a suitable matrix polymer. An intermediate structure is formed when this mixture is contacted with a suitable coagulation bath. Although the intermediate structure is mechanically sound, a final, sintered structure is generally formed by heating the intermediate structure to a temperature sufficient to coalesce the fluorinated polymer particles. On sintering the matrix polymer decomposes to form volatile gases and a carbonaceous residue.

The intermediate structures of the present invention contain substantially only those ions that are characterized as fugitive ions. The term fugitive ion is defined herein to mean, those ions or partially ionized compounds, which on heating to temperatures above 25° C., but below temperatures that cause coalescence of the poly(tetrafluoroethylene) or related polymer particles, volatilize or decompose into volatile or carbonaceous substances. The preferable lower volatilization or decomposition temperature is about 100° C.

The process of the present invention forms intermediate structures carrying substantially only fugitive ions by either, coagulating the matrix polymer in solutions substantially free of ions other than fugitive ions; or, subsequent to coagulation, but before sintering, replacing nonfugitive ions carried by the intermediate structure with fugitive ions by contacting the intermediate structure with an ion replacing solution.

Ionic species are divided into two classes for the purpose of the present invention. These classes are fugitive and nonfugitive. All ions or partially ionized compounds fall into one of these two classes. For example, sodium and sulfate ions are nonfugitive ions; the ammonium, and acetate ions and acetic acid are examples of fugitive ions. Herein below salts constituted from fugitive ions are referred to as fugitive ion salts and acids constituted from fugitive ions or partially ionized acids are referred to as a fugitive ion acid.

By the term carrying or carried, when used with respect to the intermediate fiber structure, is meant absorbed or adsorbed on the surface of, or incorporated into the interior of the intermediate structure.

In order to achieve useful coalesced fluorinated olefinic polymer fibers, it is essential that immediately before sintering the intermediate fiber structure be free of ions absorbed from the coagulation bath as well as other impurities, such as additives and/or dispersants that were present in the initial fluorinated olefinic polymer dispersion, that are detrimental to fiber sintering and/or the properties of the final, coalesced fluorinated polymer fiber. The present invention provides a method for dispersion forming articles, particularly fibers, from poly(tetrafluoroethylene) and related polymers that are free from ions which interfere with sintering or reduce the usefulness of the sintered fiber.

The present process produces intermediate fiber structures that are substantially free of harmful ions by using in the coagulation bath or in an ion replacing solution ions that are fugitive in the sintering step. These ions or partially ionized compounds volatilize or decompose into substances that are either volatile, such as water vapor and carbon oxides, or carbonaceous and do not degrade the sintered fiber general use properties. The carbonaceous materials produced from the fugitive ions of the present process, like the carbonaceous material produced by the decomposition of the matrix polymer, may be "bleached" from the sintered fiber.

Although the choice of a fugitive ion is to some extent dependent on the melting temperature of the fluorinated olefinic polymer, generally fugitive ions are those ions that decompose into volatile or carbonaceous materials at temperatures above 25° C. and below about 250° to 350° C. For example, the melting point of FEP is about 253° to 282° C., that of PFA is about 306° C. and that of PTFE is about 335° to 345° C. Fugitive ions, in the practice of the present invention, used with FEP need have a lower boiling point or decomposition temperature than those that may be used with PFA or PTFE. Of course, fugitive ions that may be used with FEP may also be used with PFA or PTFE.

Fugitive ions include organic acids and ammonium salts of organic acids formed from combinations of hydrogen, carbon, oxygen and/or nitrogen and which volatilize or decompose at temperatures greater than 25° C. but less than about 350° C. The preferred upper limit of the volatilization/decomposition temperature range is about 20° to 30° C. below the temperature at which the fluorinated polymer begins to coalesce. Examples of fugitive ion compounds include oxalic acid, acetic acid, citric acid, formic acid, propanoic acid, malic acid, butyric acid, propenoic acid, ammonium oxalate, ammonium acetate, ammonium formate, ammonium propanoate, ammonium malate, ammonium butyrate, ammonium propenoate, aqueous ammonia and mixtures thereof and other compounds having the required volatility or decomposition properties. When the fugitive ions are selected from those that decompose below 100° C., one should exercise care in the selection of the matrix polymer so that the solubility of the matrix polymer is not adversely affected by the loss of the ionic species.

Coagulation baths according to the present invention contain sufficient concentrations of fugitive ions to provide a pH and or salt concentration to coagulate the matrix polymer. Coagulation baths may contain fugitive ion salts or acids alone or a mixture of fugitive ion salts and acids.

The preferred coagulation bath is an aqueous solution although coagulation may be done in baths containing a mixture of water and minor amounts of soluble organic compounds.

In some cases it may be preferred to coagulate the matrix polymer in a coagulation bath that contains ions other than fugitive ions. In this instance the process may still enjoy the benefit of the present invention by adding, following the coagulation step but before the sintering step, an ion replacing wash to remove and replace the nonfugitive ions with fugitive ions. The contact time and concentration of fugitive ions in the ion replacing solution may be adjusted so that essentially all the nonfugitive ions carried by the intermediate fiber structure are removed or replaced.

The preferred ion replacing solution is an aqueous solution of fugitive ions although minor amounts of a water soluble organic solvent may be present in the solution. The actual composition of this wash solution, as that of the coagulation solution, may be formulated so as to optimize the strength of the intermediate fiber structure. It is not essential that the ion replacing solution be absolutely free of nonfugitive ions. As states above, it is only essential that the concentration of nonfugitive ions carried by the intermediate fiber structure be low enough that the fiber may be sintered to provide acceptable mechanical properties. Acceptable mechanical properties are indicated by a sintered fiber tensile strength of more than about 0.5 g/dtex as measured by ASTM test method D2256-90.

For example in the present process, if a sulfate ion coagulation is used, the sulfate ion coagulated fiber structure may be washed in an ion replacing solutions containing for example, acetic acid and ammonium acetate. The concentration of these fugitive ions may be adjusted so that the nonfugitive ions are replaced in the fiber structure, without the intermediate fiber having a significant loss of strength, until the sulfate ion is removed from the fiber.

The sufficiency of the time the intermediate fiber structure is contacted with the ion replacing wash and ion concentration of the wash may be optimized by testing samples of the fiber structure for the presence of residual nonfugitive ions. For example, trace element analysis such as atomic absorption or atomic emission or other instrumental methods known to one of skill in the art may be used to determine the presence or absence of elements in the fiber structure.

It has been the experience of the inventors that the nonfugitive ions carried by the intermediate fibers may be easily replaced. The inventors have observed that sodium and sulfate ions concentrations in the intermediate fibers may be made so low by use of the ion replacing wash that concentrations of these ions in process samples are below the sensitivity of some trace metal analysis technique. The concentration of nonfugitive ions immediately before sintering need not be so low for the practice of the present invention. In general it is only necessary to lower the concentration of nonfugitive ions to less than about 0.2% by weight of the wet intermediate fiber structure.

The concentrations of strong nonfugitive acids in the process of the present invention must be such that the pH of the intermediate fiber structure is about 5 or above.

A very effective but less exacting test for sufficiency of the replacing of nonfugitive ions with fugitive ions is the ease of running the intermediate fiber in the sintering step. Intermediate fiber which is too high in nonfugitive ion content is observed to be sticky and have a greater tendency to break. A practical approach to achieving sufficient nonfugitive ion replacement is to wash the fiber in the ion replacement solution until the fiber may be run successfully in the sintering step. Once the intermediate fiber runs well, the content of nonfugitive ions may be checked by chemical and instrumental analysis to establish the concentration and wash time required for processing and end use performance.

Common chemical tests may be used to test for the presence of nonfugitive ions in solutions used in fiber washing. For example in the case of sulfate ions, a drop of used wash solution could be added to a dilute solution of barium chloride. The presence of sulfate would be indicated by formation of barium sulfate precipitate. This type of simple chemical procedure could also be applied to samples of the intermediate fiber structure if the intermediate fiber structure is dissolved in a medium which would not interfere with the chemical test used to indicate the presence of the nonfugitive ion or ions in question.

Once measurements of the sufficiency of the ion replacing wash are made, processing conditions may be identified that would allow continuous production of both the intermediate and the sintered fibers requiring only periodic monitoring of the sufficiency of ion replacement.

The composition of the fugitive ion coagulation bath or the ion replacing wash may be optimized to provide a fiber structure of optimal strength by adjusting the concentrations of acid and salts to provide intermediate fibers of acceptable strength.

Matrix polymers of the present invention may be polymers containing only hydrogen, carbon, oxygen and nitrogen that are soluble in aqueous solutions that may be coagulated or precipitated by a salt or a shift of pH. Cellulosic polymers are preferred since these polymers do not melt of soften below the temperature range in which most fluorinated olefinic polymers melt and the polymer decomposes into carbonaceous material on sintering. For example, such cellulosic polymers are methylcellulose, hydroxyethylcellulose, methylhydroxypropylcellulose, hydroxypropylmethylcellulose, hydroxypropylcellulose, ethylcellulose and carboxymethylcellulose. In particular, polymers such as carboxymethylcellulose, which are generally too soluble in water to form intermediate structures which can be washed free of harmful materials, may function as matrix polymers in the process of the present invention. Neither is the present invention limited to only those matrix polymers that coagulate in fugitive ion coagulation baths since the ion replacing wash removes and replaces undesirable soluble species.

The matrix solution of any of the matrix polymers of the present invention or mixtures thereof, may be prepared by dissolving the particular matrix polymer in water or in an acid or an alkaline solution as required.

The temperature of the coagulation bath and ion replacing wash may be adjusted to provide the desired properties for the intermediate fiber structure, although the coagulation bath is typically operated in the range of 25° C. to 90° C., the preferred temperature range is from about 40° C. to about 60° C.

The spinning or forming compositions used in the process of the present invention are made by mixing an aqueous dispersion of fluorinated polymer particles with a solution of the matrix polymer of the present invention. Aqueous dispersions of fluorinated olefinic polymer particles, such as those known in the art may be used in the present process. Preferably the concentration of matrix polymer in the solution is from 3 to 10% by weight. These components are then mixed such that the ratio of the weight of the polymer particles to that of the matrix polymer in the intermediate fiber structure is from about 3 to 1 to about 20 to 1, and preferably about 9 to 1.

Although in most cases the matrix polymer solutions of the present process are stable and do not gel with age, it is preferred that the matrix polymer solution and the fluorinated polymer dispersion be mixed immediately before use to ensure that this mixture is uniform and that the particles of the fluorinated polymer dispersion do not settle.

TEST METHODS

Polymer Viscosity

A sample of the solution for which the viscosity was to be measured was filtered and placed in a vacuum chamber and kept under vacuum until traces of air bubbles were no longer visible. Enough sample was transferred into a 600 ml beaker to fill the beaker to a depth of 10 cm. The sample was then placed in a constant temperature bath set at 25° C. until the temperature was constant throughout the sample.

Viscosity was measured using a Brookfield model HB-T viscometer. The 600 ml beaker containing sample was placed under the viscometer, and a #2 spindle was attached to the viscometer. The height of the viscometer was adjusted until the surface of the fluid reached the notch on the spindle shaft, and the position of the beaker was adjusted until the spindle was centered in the sample. The viscometer was turned on so that the spindle began turning and the resulting viscosity and temperature were recorded.

The recorded Brookfield reading was converted to a viscosity by applying the appropriate ISO 9002 approved Brookfield factor finder determined from spindle number, RPM's and Brookfield reading.

EXAMPLES

Example 1

A solution was prepared by slurrying 1.58 kg. carboxymethylcellulose [CMC] having 6.2% by weight moisture and a degree of substitution of ≅0.30 in 17.7 liters of soft water at ~1.0° C. After the CMC was wetted out, 12.3 kg. of 23% sodium hydroxide solution at 4.5° C. was added to the water/CMC mixture. The resulting mixture stirred under vacuum (~29 mm Hg) for 1 hour and then filtered through 50 μm polypropylene felt bag filter into a thin film deaerator operating at ~29 mm Hg vacuum. The resulting solution had a viscosity of 3516 mPa.s at 25° C.

A stream of the above solution was merged with a stream of TEF 3311 poly-(tetrafluoroethylene) [PTFE] dispersion (available from DuPont de Nemours and Company, Wilmington, Del.) at relative rates such that the ratio of PTFE to CMC was 8.1. The merged stream was mixed in an in-line static mixer. The resulting mixture was then pumped through a spinneret containing 120 holes, each hole 7 mils in diameter) submerged under the surface of a coagulation solution. The coagulation solution was 5% sulfuric acid and 18% sodium sulfate. Its temperature was held at 52°±2° C.

The resulting intermediate fibers were then passed through a wash bath of 0.4% acetic acid held at 44° C. and then onto a set of rotating hot rolls. The surface temperature of these rolls was held at 250°±5° C. to dry the intermediate fiber.

The yarn was passed to another set of rotating hot rolls. The surface temperature of these rolls was held at 375°±5° C. to sinter the fiber.

The yarn was passed to a set of unheated "draw rolls" on which multiple wraps were placed. The speed difference between the second set of hot rolls and the "draw rolls" was such that the yarn was drawn 8.08 times. This is known as the draw ratio. From the draw roll the yarn was wound on a paper tube.

The resulting sintered yarn had a linear density of 757 dtex. Its tenacity was 1.63 g/dtex.

Example 2

The fiber was spun as in example 1 except at a draw ratio of 7.73.

The resulting yarn had a linear density of 770 dtex. Its tenacity was 1.67 g/dtex.

Example 3

The fiber was spun as in example 1 except at a draw ratio of 6.31.

The resulting yarn had a linear density of 882 dtex. its tenacity was 1.48 g/dtex.

Following the ion replacing wash, a sample of the intermediate fiber structure was analyzed by emission spectroscopy for sodium as a way to measure the concentration of sodium in the dried and sintered fiber structure. The sodium content was found to be 570 ppm.

Example 4

The fiber was spun as in example 1 except at a draw ratio of 5.05.

The resulting yarn had a linear density of 1187.7 dtex. Its tenacity was 1.21 g/dtex.

Example 5

The fiber was spun as in example 1 except at a draw ratio of 4.29.

The resulting yarn had a linear density of 1187.7 dtex. Its tenacity was 1.19 g/dtex.

Example 6

A solution was prepared by slurrying 1.26 kg. of methylcellulose [MC] (3.3% moisture) in 30.3 liters of soft water at ~80° C. After the MC was wetted out, the temperature was reduced to ~25° C. The resulting mixture stirred under vacuum (~29 mm Hg) for 1 hour and then filtered through a 10 μm polypropylene felt bag filters into a thin film deaerator operating at ~29 mm Hg vacuum. The resulting solution had a viscosity of ~5000 mPa.s at 25° C.

A stream of the above solution was merged with a stream of DuPont TEF 3311 poly-(tetrafluoroethylene) [PTFE] dispersion at relative rates such that the ratio of PTFE to MC was 7.9 and mixed in an in-line static mixer. The resulting mixture was then pumped through a spinneret containing 180 holes (6 mil diameter) submerged under the surface of a coagulation bath. The coagulation bath composition was 40% ammonium acetate. Its temperature was held at 65°±5° C. The resulting fibers were then passed onto a set of rotating hot rolls. The surface temperature of these rolls was held at 200°±5° C. to dry the fiber.

The yarn was passed to another set of rotating hot rolls. The surface temperature of these rolls was held at 360°±5° C. to sinter the fibers.

The yarn was passed to a set of unheated "draw rolls" on which multiple wraps were placed. The speed difference between the second set of hot rolls and the "draw rolls" was such that the yarn was drawn 4.3 times. This is known as the draw ratio. From the draw roll the yarn was wound on a paper tube.

The resulting yarn had a linear density of 731 dtex. Its tenacity was 0.891 g/dtex.

Example 7

The fiber was spun as in example 6 except at a draw ratio of 5.1.

The resulting yarn had a linear density of 460 dtex. Its tenacity was 0.981 g/dtex.

Example 8

The fiber was spun as in example 6 except at a draw ratio of 6.22.

The resulting yarn had a linear density of 413 dtex. Its tenacity was 1.44 g/dtex.

Example 9

The fiber was spun as in example 6 except at a draw ratio of 7.07.

The resulting yarn had a linear density of 616 dtex. Its tenacity was 1.42 g/dtex.

What is claimed is:

1. A process for making a dispersion spun fluorinated olefinic polymer fiber comprising the steps of:

(a) forming a mixture of an aqueous dispersion of particles of the fluorinated olefinic polymer with a aqueous solution of a matrix polymer;

(b) extruding the mixture into a coagulation bath containing a concentration of ions which coagulate the matrix polymer to form an intermediate fiber structure which carries ionic species; and (c) sintering the intermediate fiber structure to decompose the matrix polymer and coalesce the fluorinated olefinic polymer particles wherein immediately before sintering the ionic species are primarily fugitive ions wherein fugitive ions are those ions and partially ionized compounds which on heating to temperatures above 25° C., but below temperatures that cause coalescence of the fluorinated olefinic polymer particles volatilize or decompose to form only volatile substances or carbonaceous residues.

2. The process of claim 1 wherein the intermediate fiber structure is coagulated in an aqueous solution containing essentially fugitive ions.

3. The process of claim 1 wherein subsequent to coagulating the matrix polymer in a coagulation solution containing ionic species selected from the group consisting of nonfugitive, fugitive or mixtures thereof, but before sintering, the intermediate fiber structure is contacted with an ion replacing solution which contains essentially fugitive ions.

4. The process of claim 1 wherein the fluorinated polymer is selected from the group consisting of poly (tetrafluoroethylene), co-polymers of tetrafluoroethylene and hexafluoropropene, co-polymers of tetrafluoroethylene and perfluoroalkyl-vinyl ethers and fluorinated olefinic ter-polymers of these monomers.

5. The process of claim 1 wherein the matrix polymer is selected from the group consisting of methylcellulose, hydroxyethylcellulose, methylhydroxypropylcellulose, hydroxypropylmethylcellulose, hydroxypropylcellulose, ethylcellulose and carboxymethylcellulose.

6. The process of claim 1 wherein the fugitive ions are selected from the group consisting of oxalic acid, acetic acid, citric acid, formic acid, propanoic acid, malic acid, butyric acid, propenoic acid, ammonium oxalate, ammonium acetate, ammonium formate, ammonium propanoate, ammonium malate, ammonium butyrate, ammonium propenoate, aqueous ammonia and mixtures thereof.

* * * * *